US005548496A

United States Patent [19]

Hart et al.

[11] Patent Number: 5,548,496

[45] Date of Patent: Aug. 20, 1996

[54] PORTABLE LAMP ASSEMBLY

[76] Inventors: Don B. Hart, 1431 Via Plata, Long Beach, Calif. 90810-1462; George Hillinger, 129 N. LeDoux Rd., Beverly Hills, Calif. 90211

[21] Appl. No.: 365,041

[22] Filed: Dec. 27, 1994

[51] Int. Cl.[6] ..... F21V 21/08

[52] U.S. Cl. ..... 362/396; 362/399; 362/400; 362/418; 362/427; 362/370; 362/371; 362/373

[58] Field of Search ..... 362/396, 269, 362/399, 400, 410, 411, 413, 414, 418, 419, 431, 376, 368, 370, 371, 373, 295, 285, 287, 294, 61, 457; 248/258, 257, 419, 263.1

[56] References Cited

U.S. PATENT DOCUMENTS

| | | | |
|---|---|---|---|
| 4,075,470 | 2/1978 | Moore | 362/287 |
| 4,458,304 | 7/1984 | Imsdahl | 362/396 X |
| 4,535,391 | 8/1985 | Hsiao | 362/183 |
| 5,003,450 | 3/1991 | Burton et al. | 362/387 |
| 5,060,894 | 10/1991 | Hillinger | 248/170 |
| 5,088,014 | 2/1992 | Boughey | 362/132 |
| 5,126,928 | 6/1992 | Hughes | 362/287 |
| 5,142,467 | 8/1992 | Yuen | 362/418 X |
| 5,195,823 | 3/1993 | Sidabras | 362/387 |
| 5,205,645 | 4/1993 | Lee | 362/371 X |
| 5,307,255 | 4/1994 | Chen | 362/410 |
| 5,414,608 | 5/1995 | Stekeknburg | 362/376 |

*Primary Examiner*—Ira S. Lazarus
*Assistant Examiner*—Thomas M. Sember
*Attorney, Agent, or Firm*—Albert O. Cota

[57] ABSTRACT

A portable lamp assembly (10) consisting of a lamp housing (12) that incorporates a quartz halogen lamp (50) and that features an articulated lamp-housing support (20). The support (20) consists of a U-shaped bracket (22) having a horizontal member (22A) and two side members (22B). The side members are swivelly attached to the lower section (12B) of the housing (12). To the bottom surface of the horizontal member (22A) is attached a clevis structure (26) to which is swivelly attached a first end (28A) of a clamp support link (28). The second end (28B) of the support link is rigidly attached to a first handle (30A) of a spring-loaded clamp (30). The clamp (30) functions as a third leg that when positioned vertically and used in combination with a pair of legs (24) that extend from the structure (20), allows the assembly (10) to be stably placed upon a horizontal surface. The use of the clamp support link (30A) also allows the clamp (30) to be positioned within an arcuate plane and attached to various lamp attachment structures.

21 Claims, 4 Drawing Sheets

PORTABLE LAMP ASSEMBLY

TECHNICAL FIELD

The invention pertains to the general field of portable lamp assemblies. More particularly, the invention pertains to a portable lamp assembly having an articulated lamp-attachment clamp that also functions as one of the lamp legs when the lamp is placed upon a flat surface.

BACKGROUND ART

The utility provided by portable lamp assemblies is well established. Small portable lamp assemblies, especially those that employ quartz halogen lamps, are especially well suited for home use as well as for professional use that includes automotive repair shops, construction and excavation sites, photography studios and in various situations where a portable light source is required to illuminate specific objects and areas.

Most portable lamp assemblies are equipped with either a handle for carrying or are mounted on a stand for stationary, long-term positioning. These lamps are most often connected to a standard 120 volt a-c receptable by way of an electrical power cord. Despite their relative ease of use, the prior art lamps are often not designed to be selectively and easily positioned and secured for more unique or specialized applications.

The design of the present portable lamp assembly allows for greater use applications due to a heavy-duty spring-loaded clamp. This clamp allows the assembly to be clamped in various positions to various types of mounting structures, The clamp can also be positioned to serve as one of the legs when the assembly is placed upon a substantially flat surface.

A search of the prior art, which included patents and sales literature, did not disclose a portable lamp assembly that included a spring-loaded assembly attachment clamp that also functions as one of the assemblies legs. However, the following U.S. patents were considered related:

| U.S. Pat. No. | INVENTOR | ISSUED |
|---|---|---|
| 5,195,823 | Sidabras | 23 March 1993 |
| 5,060,894 | Hillinger | 29 October 1991 |
| 5,003,450 | Burton | 26 March 1991 |

The U.S. Pat. No. 5,195,823 Sidabras patent discloses a lamp and extension cord set consisting of a removable extension cord reel and lamp set mounted onto a stable base frame platform. The extension cord reel connects a lamp to an external power supply and is provided with a curved top bar as a safety feature and a handlebar for carrying the reel. The lamp set contains the light source within a lamp housing and a lamp cover. A power switch and a separate retractable power cord are attached to the lamp set for connection to the external power supply without the extension cord reel. The lamp may be pivoted or rotated both horizontally and vertically with respect to the base frame to adjust the direction of the light.

The U.S. Pat. No. 5,060,894 Hillinger patent discloses a collapsible three leg structure that is used to support a stand with a T-section having at least one light fixture attached to its end. The collapsible legs are attached to the stand by a disk member held within a pair of ears. One of the ears has a toothed opening as does the disk member. A gear member may be moved to a locked position where the gear contacts the toothed portions of the disk member and one of the ears which locks the disk in a fixed position. When the gear is moved out of contact with the disk member, the disk member is free to move with respect to the pair of ears. Thus, allowing the legs to be placed in various locked positions.

The U.S. Pat. No. 5,003,450 Burton patent discloses a portable light fixture which is specifically adapted to be hand-held and utilized for emergency applications, particularly with respect to motor vehicles. The fixture consists of a conical-shaped lens which is rotatably mounted to a cylindrical housing. Disposed within the interior of the housing is a spool which is rigidly attached on one end of the lens and on the other end to a plate. The plate is located on the bottom of the housing, such that the lens, spool and bottom plate will rotate in unison. The spool further includes a wound electrical cord of which one end is connected to a conventional light bulb disposed beneath the lens. The opposite end of the cord includes a connector which may be inserted into a cigarette lighter receptacle of an automobile, or alternatively connected by way of alligator clips to the battery terminals of the automobile.

For background purposes and as indicative of the art to which the invention relates reference may be made to the remaining cited patents.

| PATENT NO. | INVENTOR | ISSUED |
|---|---|---|
| 5,307,255 | Chen | 26 April 1994 |
| 5,126,928 | Hughes | 30 June 1992 |
| 5,088,014 | Boughey | 11 February 1992 |
| 4,535,391 | Hsiao | 13 August 1985 |
| 4,075,470 | Moore | 21 February 1978 |

DISCLOSURE OF THE INVENTION

The disclosed invention is designed to provide a user with a small, portable lamp assembly that is very convenient to use and that can be quickly positioned and attached to provide optimal illumination. In its most basic designs, the portable lamp assembly consists of:

a) a lamp housing that includes a lower section to which is attached a lamp-power junction box. From the junction box, the utility 120 volt a-c power source is routed to the assembly, b) a lamp housing support having a lower horizontal member having upwardly extending side members. The side members are pivotally attached to the sides of the lower section of the lamp housing, c) a a downwardly extending leg that is rigidly attached to each side member of the lamp housing support, d) a support link having a first end and a second end. The first end is swivelly attached to the lower horizontal member of the lamp housing support, and e) a spring-loaded clamp having a first handle and a second handle. The first handle is rigidly attached to the second end of the support link. The support link provides two functions:

1) it allows the clamp-to be selectively positioned and attached to a lamp attachment structure, and 2) it allows the clamp to function as a third leg that when used in combination with the pair of downwardly extending legs, allows the lamp assembly to be placed upon a substantially level surface.

In view of the above disclosure, it is the primary object of the invention to produce a portable light assembly that has a spring-loaded clamp swivelly attached to the lamp housing. The clamp allows the lamp housing to be attached to various attachment structures and that also serves as one of the support legs when the lamp assembly is placed upon a flat surface.

In addition to the primary object of the invention it is also an object of the invention to produce a portable light assembly that:

- is housed within a strong lamp housing that protects the light assembly from all sides,
- includes a means for positioning the light housing in various vertical and horizontal positions,
- operates with a halogen lamp that produces an even light distribution,
- can be plugged into any standard 120-volt a-c power outlet,
- can be manufactured from a variety of metals and plastics,
- is rugged in construction,
- is reliable and virtually maintenance free with the exception of replacing the halogen bulb, and
- is cost effective from both a manufacturer's and consumer's points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
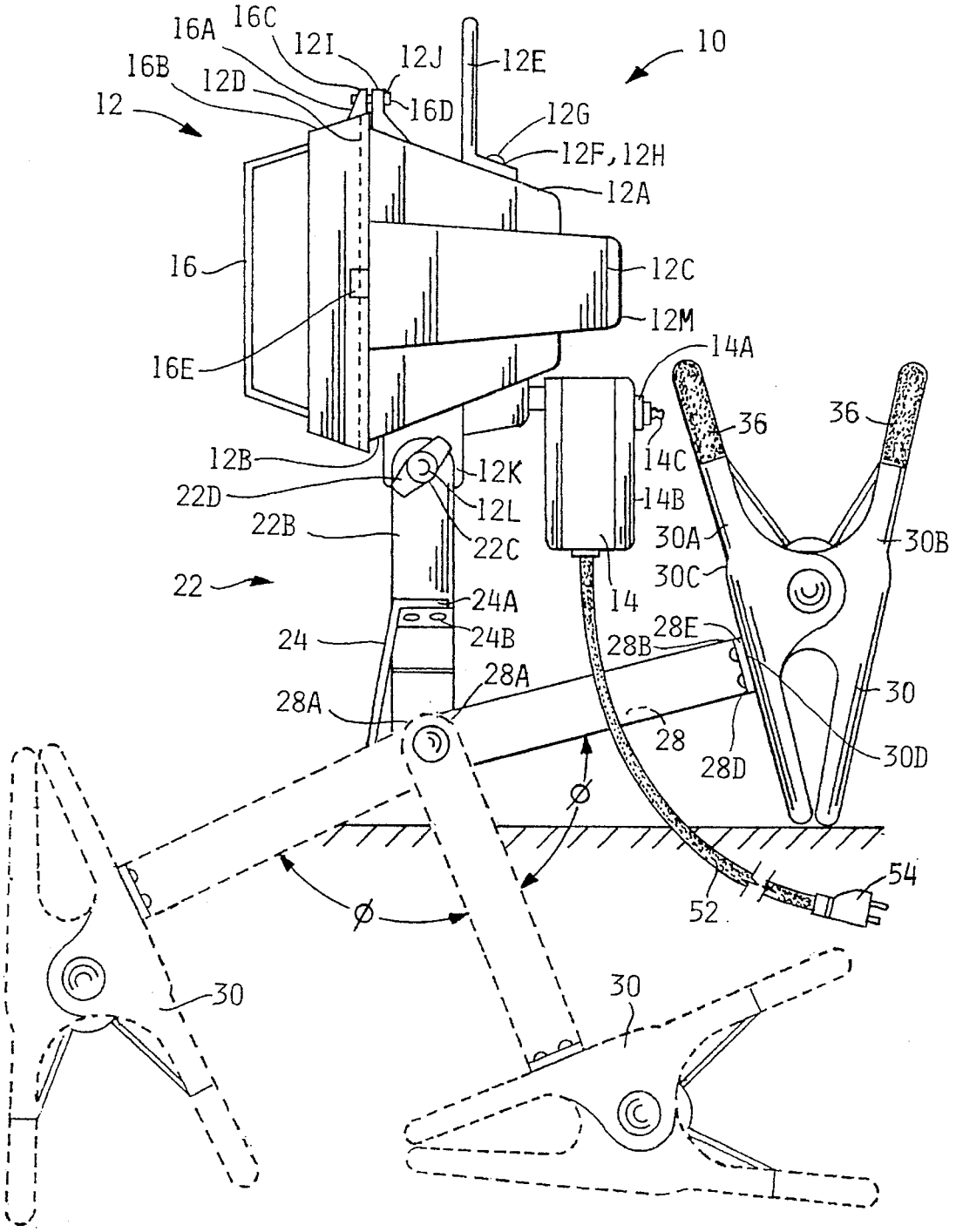
FIG. 1 is a side elevational view of the portable lamp assembly showing by solid lines, the spring-loaded clamp positioned as a third leg that in combination with the pair of assembly legs allows the assembly to be placed upon a level surface. The figure also shows by dashed lines, the clamp in two of its selectable, assembly attachment positions.

The best mode for carrying out the portable lamp assembly 10 is presented in terms of a preferred embodiment that is shown in FIGS. 1–9 and that is comprised of the following major elements: a lamp housing 12; a lamp-power junction box 14; a protective lamp guard 16 and an articulated lamp housing support 20. The assembly operates in combination with a lamp, that preferably consists of a halogen lamp 50 and a power cord 52.

Figure 2:
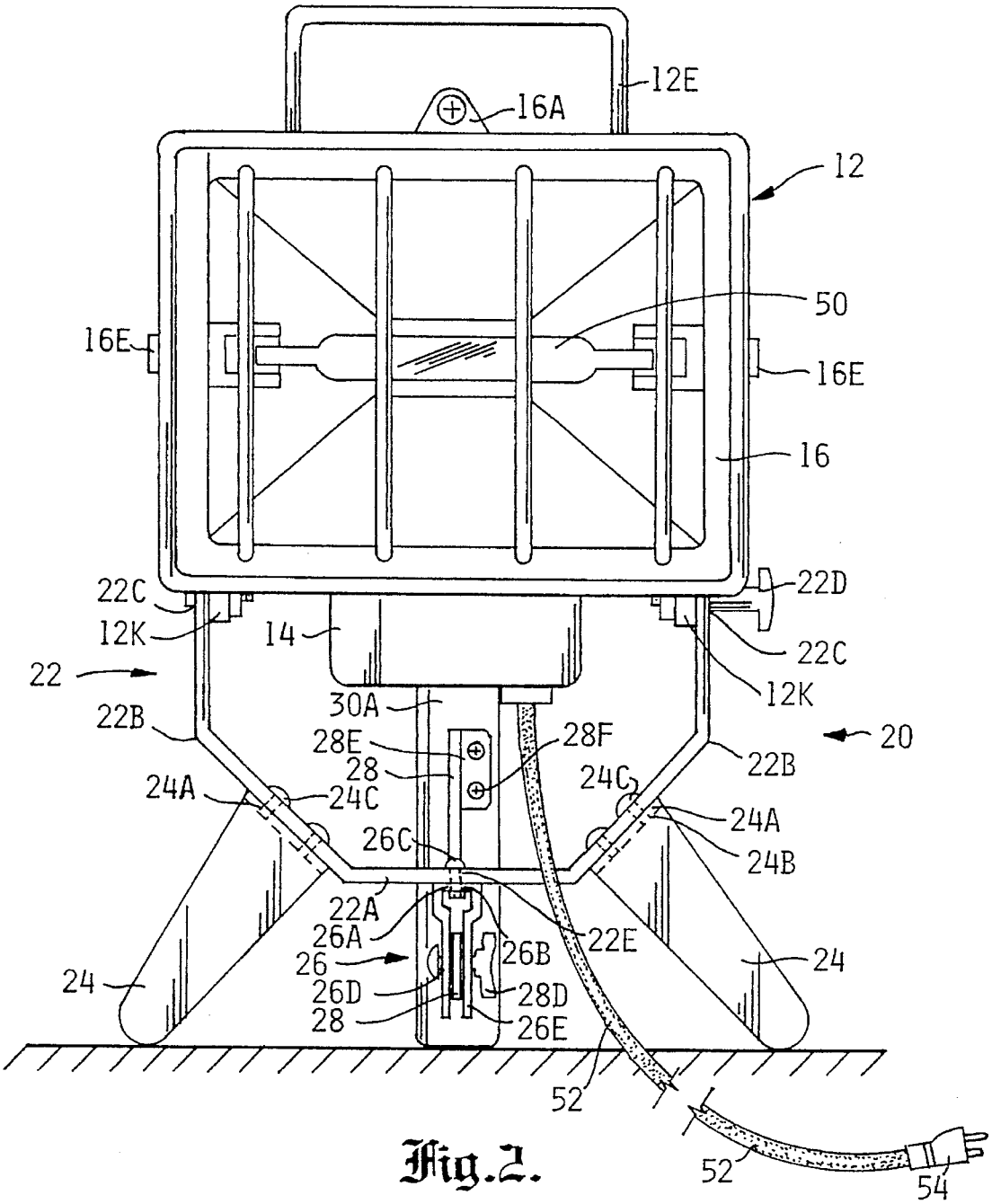
FIG. 2 is a front elevational view of the portable lamp assembly.

The lamp housing 12 as shown in FIGS. 1 and 2, consists of an upper section 12A, a lower section 12B a rear section 12C, and a front edge 12D. The housing can be manufactured of a high impact plastic or preferably it is casted in metal.

The upper section 12A includes a handle 12E that is attached by an attachment means. This means preferably consists of boring two threaded bores 12F into the upper section into which are then threaded two bolts 12G that are first inserted through two handle bores 12H as shown in FIG. 1. Near the upper front edge 12D of the housing is centrally located an upward extending lamp-guard mounting tab 12I that is used to attach the protective lamp guard 16 as described infra.

The lower section 12B as shown in FIGS. 1 and 2, includes near each side edge, a downward extending lip 12K. The lips are used to attach the articulated lamp housing support 20 as described infra. Also, attached to the lower section is a lamp-power junction box 14. The junction box contains a combination switch-circuit breaker that is electrically connected between the halogen lamp 50 and the power cord 52 as best shown in FIG. 2. The power cord includes a connector 54 that plugs into a 120 volt a-c utility power receptacle. The power to the lamp is controlled by a push-button switch 14A that projects through the front panel 14B. Around the push-button switch is attached a waterproof boot 140 as also shown in FIG. 1.

The rear section 120 as shown in FIG. 1, has an integrally cast heat sink surface 12M. The heat sink helps to dissipate some of the accumulated heat within the housing that is generated by the lamp 50. To complete the lamp housing 12, a protective lamp guard 16 is attached around the front edge 12D of the housing by an attachment means. The attachment means consists of a housing mounting tab 16A that extends upwardly from the center of the upper section 18B of the housing. The tab 16A includes a bore 18C that is in alignment with a threaded bore 12J located on the lamp-guard mounting tab 12I located on the upper section 12A of the housing 12. To secure the protective lamp guard 16, a threaded bolt 16D is inserted through the bore 160 and threaded into the threaded bore 12J. To further secure the guard 16, a spring clip 16E may be inserted over each of the side edges of the guard as shown in FIGS. 1 and 2.

The articulated lamp-housing support 20 as shown in FIGS. 1 and 2 is comprised of a U-shaped bracket 22, a pair of legs 24, a clevis structure 26, a clamp support link 28 and a spring-loaded clamp 30.

The U-shaped bracket 22 as best shown in FIG. 2, includes a lower horizontal section 22A having upwardly extending side members 22B. The side members have upper ends that are pivotally attached by an attachment means to the respective downward extending lip 12K located on the lower section of the housing 12. In the preferred attachment means, the lips 12K have therethrough a bracket bore 12L as shown in FIG. 1 and the upper end of each side member 22B has therethrough a lip bore 220. Through the bores 12L and 22C is inserted a threaded bolt that is tightened by conventional nut or preferably by a a wing nut 22D as shown on the right side of FIG. 2.

To each side member 228 is rigidly attached by an attachment means a downwardly extending leg 24. To secure the legs they are made with an upper 90° flange 24A having at least one and preferably a pair of threaded bores 22B therethrough. The threaded bores 24B ape aligned with a pair of bores 22D located on each side member 22B of the U-shaped bracket 22. Through these bores is then threaded a threaded bolt 24C as best shown in FIG. 2. As shown in FIGS. 1 and 2, the legs 24 can be attached to the side members 228 of the U-shaped bracket 22 with the longitudinal edges of the legs vertically aligned; or, as shown in FIGS. 3 and 4, the legs can be attached with their longitudinal edges horizontally aligned.

To the center of the horizontal section 22A is rigidly attached by an attachment means a downwardly extending clevis structure 26 as shown in FIGS. 1 and 2. To attach the clevis structure as shown in FIG. 2, the horizontal member 26A of the structure 26 has therethrough a bracket bore 26B. This bore is aligned with a clevis bore 22E centrally located on the horizontal section 22A of the U-shaped bracket 22. Through these respective bores is then inserted a bolt and nut combination 26C that when tightened, the clevis structure is rigidly secured.

Figure 3:
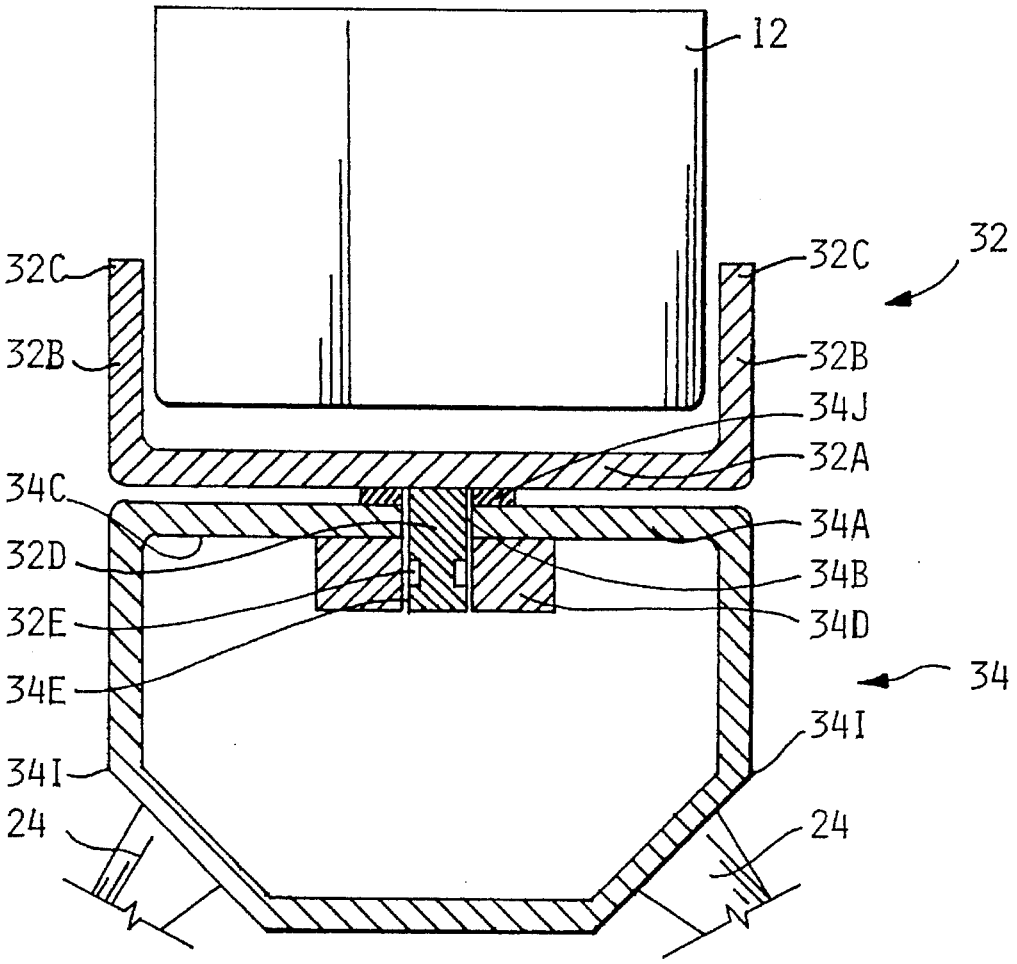
FIG. 3 is a partial front elevational and sectional view of the portable lamp housing that uses an articulated lamp housing support that allows the lamp housing to be rotated vertically and horizontally.
Figure 4:
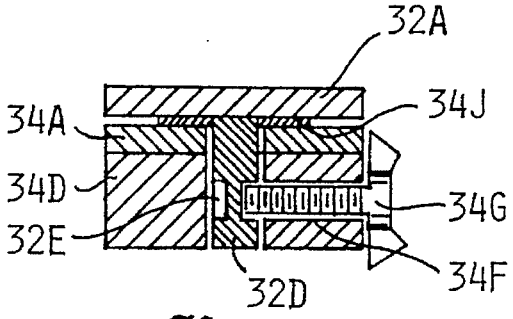
FIG. 4 is a partial side elevational and sectional view of the lower horizontal member of the upper rotatable bracket attached to the upper horizontal member of the lower stationary bracket via the swivel pin.

The clamp support link 28 as shown in FIGS. 1 and 3, includes a first end 28A and a second end 28B as best shown in FIG. 1. The first end 28A is swivelly attached, by an attachment means, to the clevis structure 26. In this attachment means, the first end 28A has a clevis bore 280 therethrough that is in alignment with a a pair of support bores 26D located on the vertical members 26E of the clevis structure 26. Through these bores is inserted a combination bolt and wing nut 28D that allows the support link to be swivelly positioned and that when tightened, the first end 28A of the support link 28 is rigidly secured. The second end 28B of the support link 28 has a 90° attachment flange 28E that has at least one clamp bore 28F therethrough.

The final element that comprises the articulated lamp-housing support 20 is the spring-loaded clamp 30. This clamp has a first handle 30A and a second handle 30B as shown in FIG. 1. The first handle 30A has an outer surface 300 that includes at least one link bore 30D and preferably two link bores 30D. These bores are located so that they are aligned with the respective clamp bores 28F on the attachment flange 28E located on the second end 28B of the support link. When a combination bolt and nut are inserted through the respective bores and the nut is tightened, the clamp 30 is rigidly secured to the clamp support link 28.

As shown in FIG. 1, the clamp 30 in combination with the clamp-support link 28 is designed to be selectively positioned within an arcuate vertical plane $\phi$ and clamped to a lamp attachment structure (not shown). The swivel action and the various arcuate positions are illustrated by the clamps shown by the dashed lines. In addition to the various assembly clamping positions available, the clamp 30 also function as a third leg. When this third leg is used in combination with the pair of downwardly extending legs 24, as also shown in FIG. 1, the lamp assembly 10 can be in a stable way, placed upon a substantially level surface.

The articulated lamp-housing support 20 can also be designed, as shown in FIGS. 3 and 4, to allow the lamp housing 12 to be selectively rotated in a horizontal direction. In this design configuration, the support 20 includes an upper rotatable bracket 32 and a lower stationery bracket The upper rotatable bracket 32 as shown in FIG. 3, has a lower horizontal member 32A with upwardly extending side members 32B. The upper ends 32C of the horizontal member 32A are pivotally attached to the respective lip 12K extending from the lower section 12B of the housing 12 as described supra. The lower horizontal member 32A has a centered, downward extending swivel pin 32D that includes a radial groove 32E.

The lower stationary bracket 34, as also shown in FIG. 3, consists of an upper horizontal member 34A that has integrally attached, a lower horizontal section 34H via two side members 34I.

The upper horizontal member includes therethrough, a centered pin bore 34B that is sized to rotatably receive the swivel pin 32D. On the lower side 34C of the horizontal member 34A is attached, by an attachment means, a swivel pin retaining block 34D as shown in FIGS. 3 and 4. This block has a vertical pin bore 34E therethrough that is in alignment with the centered pin bore 348. The block 34D also has a threaded horizontal pin-securing bore 34F that is aligned with the radial groove 32E on the swivel pin 32D, when the bracket 32 is placed on top of the bracket 34.

To selectively set and secure the housing 12 in a horizontal position, a threaded bolt and wing nut 34G combination is threaded through the horizontal pin securing bore 34F and into the pin's radial groove 32E as shown in FIG. 4. When the wing nut is tightened, the housing is secured. To facilitate the rotation of the housing 12, a washer 34J may be placed over the pin 32D between the upper rotatably bracket 32 and the lower stationary bracket 34 as shown in FIGS. 3 and 4.

To enhance the utility of the portable lamp assembly 10, an attachment hook 56, leg caps 38, a clamp resilient sheath 40 and a d-c to a-c voltage converter 42 can be utilized.

Figure 7:
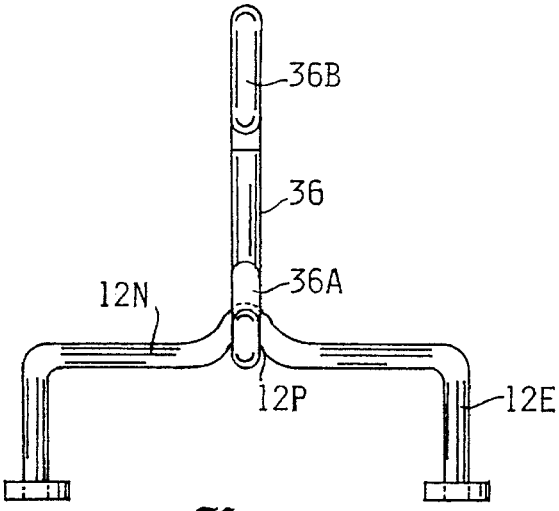
FIG. 7 is a front elevational view of an assembly attachment hook attached to the handle. The figure also shows a handle having a centered groove that allows the book to remain centered on the handle.
Figure 8:
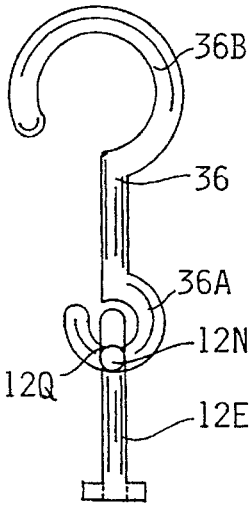
FIG. 8 is a side elevational view of the hook shown in FIG. 7.

The attachment hook 38 as shown in FIGS. 7 and 8 includes a lower hook section 36A and an upper hook section 36B. The lower hook section 36A is sized to fit under the handle 12E. The upper hook section 36B is sized to be hooked to an overhead structural member to allow the light assembly 10 to project its illumination from above a work area. To allow the lower hook section 36A to remain centered on the handle 12E, the handle's horizontal member 12N can be made with a centered, upward extending groove 12P that is sized to accept and retain the lower hook section 36A as best shown in FIG. 7.

Figure 5:
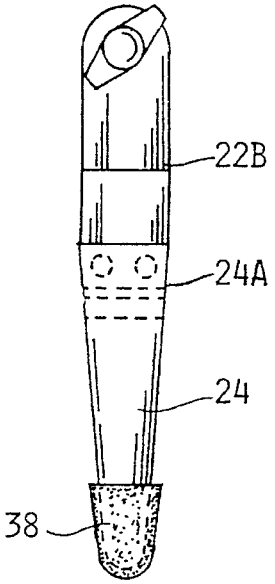
FIG. 5 is a side elevational view showing the leg attached to the side member lamp housing support with the legs longitudinal edges horizontally aligned.
Figure 6:
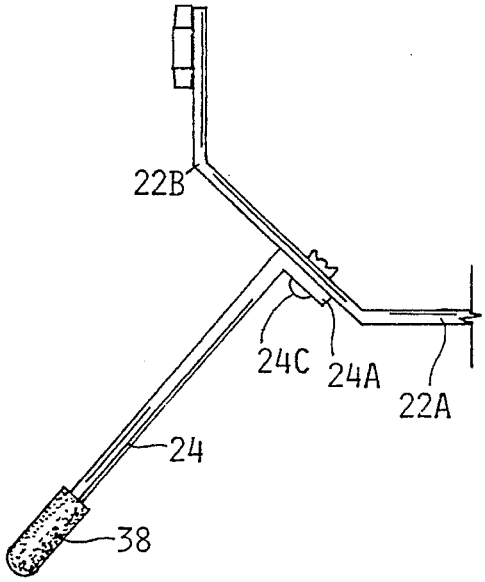
FIG. 6 is a partial, front elevational view of the leg shown in FIG. 5.

The leg caps 38 are made of a plastic material and ape inserted over the ends of the legs 24 as shown in FIGS. 5 and 6. The caps minimize surface marring and slippage. The clamp resilient sheaths 40 as shown in FIG. 1, are placed over the first and second handles to provide improved gripping and comfort.

Figure 9:
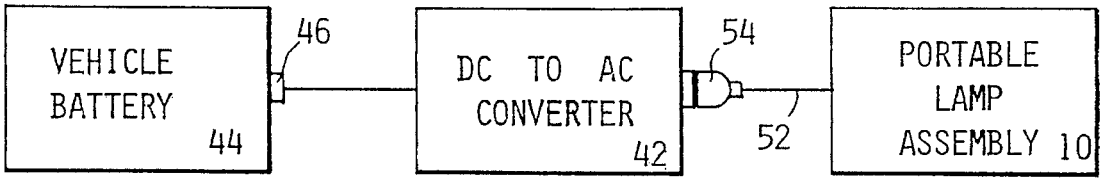
FIG. 9 is a block diagram of a d-c to a-c converter that allows a portable lamp assembly to be operated from a d-c power source as is available from a vehicle battery.

The d-c to a-c voltage converter 42 as shown in FIG. 9 allows the portable lamp assembly to operate from a d-c power source such as is available from a vehicle. The converter 38 includes an input and an output; the input is connected to a vehicle battery 44 via a cable 46 that has attached a connector that plugs into the vehicle's cigarette lighter receptacle. The output is connected directly to the portable lamp assembly 10 via the power cord 52 and connector 54.

While the invention has been described in complete detail and pictorially shown in the accompanying drawings it is not to be limited to such details, since many changes and modifications may be made to the invention without departing from the spirit and the scope thereof. For example, in lieu of the attachment hook 32, a tethered suction cup can be used to maintain the assembly 10 in an overhead position. Hence, it is described to cover any and all modifications and forms which may come within the language and scope of the claims.

We claim:

1. A portable lamp assembly comprising:

a) a lamp housing that includes a lower section, b) a lamp-power junction box attached to said lamp housing, c) a lamp housing support having a lower horizontal member having upwardly extending side members that are pivotally attached to the lower section of said lamp housing, d) a pair of downwardly extending legs rigidly attached to each side member of said lamp housing support, e) a support link having a first end and a second end, where the first end is swivelly attached to the lower horizontal member of said lamp housing support, and f) a spring-loaded clamp having a first handle and a second handle, where the first handle is rigidly attached to the second end of said support link, where said support link allows said clamp to be selectively positioned and attached to a lamp attachment structure and also functions as a third leg that when used in combination with the pair of downwardly extending legs allows said lamp assembly to be placed upon a substantially level surface.

2. The assembly as specified in claim 1 wherein said lamp assembly comprises a halogen lamp.

3. The assembly as specified in claim 2 further comprising an attachment hook having a lower hook section sized to fit under said handle and an upper hook section sized to be hooked to an overhead structural member to allow said light assembly to project its illumination from above a work area.

4. A portable lamp assembly comprising:

a) a lamp housing having an upper section, a lower section, a rear section a front edge and two sides, where from said each side of the lower section is located a downward extending lip, b) a lamp-power junction box attached to the lower section of said lamp housing, where said junction box contains a combination switch-circuit breaker electrically connected between the lamp and a power cord having a connector that plugs into an a-c utility power receptacle, c) an articulated lamp-housing support comprising:

(1) a U-shaped bracket having a lower horizontal section having upwardly extending side members further having upper ends that are pivotally attached by a first attachment means, to the respective lips extending from the lower section of said housing, (2) a pair of downwardly extending legs rigidly attached, by second attachment means to each side member, (3) a downwardly extending clevis structure rigidly attached by a third attachment means to the lower horizontal section, and (4) a clamp support link having a first end and a second end, where the first end is swivelly attached, by a fourth attachment means, to the clevis section, and d) a spring-loaded clamp having a first handle and a second handle, where the first handle has an outer surface that is rigidly attached, by a fifth attachment means to the second end of said support link, where said support link allows said clamp to:

(1) be selectively positioned within an arcuate vertical plane and clamped to a lamp attachment structure, and (2) function as a third leg that when used in combination with the pair of downwardly extending legs allows said lamp assembly to be stablely placed upon a substantially level surface.

5. The assembly as specified in claim 4 wherein said lamp assembly comprises a halogen lamp.

6. The assembly as specified in claim 4 wherein said combination switch-circuit breaker is operated by a push-button switch that projects through a front of said junction box and that is protected by a waterproof boot.

7. The assembly as specified in claim 4 further comprising a handle attached to the upper section of said housing by a sixth attachment means, with said handle having a horizontal member having a centered, upward extending groove.

8. The assembly as specified in claim 7 further comprising an attachment hook having a lower hook section sized to fit under the groove located on said handle and an upper hook section sized to be hooked to an overhead structural member to allow said light assembly to project its illumination from above a work area.

9. The assembly as specified in claim 4 wherein said reap section of said housing further comprises an outer facing heat sink surface.

10. The assembly as specified in claim 4 further comprising a protective lamp guard removably attached around the front edge of said lamp housing by a seventh attachment means.

11. The assembly as specified in claim 4 wherein said first attachment means comprises:

a) said lips having therethrough a bracket bore, b) said upper ends of each said side member having therethrough a lip bore, and c) a threaded bolt inserted through said bracket bores and said lip bores, where said bolt is tightened by a winged nut.

12. The assembly as specified in claim 4 wherein said second attachment means comprises:

a) each said leg having an upper end with a 90° flange having at least one threaded bore therethrough, b) each said side member of said U-shaped bracket having at least one leg bore therethrough, and c) a threaded bolt inserted into at least one leg bore and threaded into at least one threaded bore.

13. The assembly as specified in claim 12 wherein each said leg is attached to the side member of said U-shaped bracket with the longitudinal edges of said leg vertically aligned.

14. The assembly as specified in claim 12 wherein each said leg is attached to the side member of said U-shaped bracket with the longitudinal edges of said leg horizontally aligned.

15. The assembly as specified in claim 4 wherein said third attachment means comprises:

a) said clevis structure having a horizontal member having therethrough a bracket bore, b) said horizontal member of said U-shaped bracket having a clevis bore therethrough, and c) a bolt and nut combination where when said bolt is inserted through the bracket bore and the clevis bore and the nut is tightened, said clevis structure is rigidly attached to the lower horizontal member of said U-sahped bracket.

16. The assembly as specified in claim 4 wherein said fourth attachment means comprises:

a) said first end of said support link having a clevis bore therethrough, b) said clevis structure having a pair of support bores therethrough, and c) a threaded bolt inserted through said clevis bores and said support bore, where said bolt is tightened by a winged nut.

17. The assembly as specified in claim 4 wherein said fifth attachment means comprises:

a) said clamp support link having a second end that further comprises a 90° attachment flange further having at least one clamp bore therethrough, b) said first side of said clamp further having at least one link bore therethrough, and c) a bolt and nut combination that when inserted through the clamp and link bores and tightened, said support link is rigidly attached to said clamp.

18. The assembly as specified in claim 4 wherein the first handle and second handle of said spring-loaded clamp have upper sections into which are inserted a resilient sheath.

19. The assembly as specified in claim 4 further comprising a means for allowing said lamp housing to be horizontally positioned.

20. The assembly as specified in claim 19 wherein said means for allowing said lamp housing to be horizontally positioned is accomplished by an articulated lamp housing support that comprises:

a) an upper rotatable bracket having a lower horizontal member with upwardly extending side members that have upper ends which are pivotally attached, by an eighth attachment means, to the respective lip extending from the lower section of said housing, with said lower horizontal member having a centered, swivel pin further having a radial groove, b) a lower stationary bracket comprising:

(1) an upper horizontal member having a centered pin bore therethrough that is sized to rotatably receive the swivel pin, and having a lower side that has attached by a ninth attachment means, a swivel pin retaining block having a vertical pin bore therethrough that is in alignment with the centered pin bore, with said block further having a threaded, horizontal pin-securing bore that is aligned with the radial groove on the swivel pin, (2) a U-shaped member having a lower horizontal section having upwardly extending side members that are integrally attached to the respective ends of the upper horizontal member, and (3) a threaded bolt and wing nut combination, where when the bolt is threaded into the horizontal pin securing bore and tightened by the wing nut, said lamp housing is secured in a selectable horizontal position.

21. A portable lamp assembly comprising:

a) a lamp housing having an upper section, a lower section, a rear section, a front edge, and two sides said where from each side of the lower section is located a downward extending lip, b) a lamp-power junction box attached to the lower section of said lamp housing, where said junction box contains a combination switch-circuit breaker electrically connected between the lamp and a power cord having a connector that plugs into an a-c utility power receptacle, c) an articulated lamp-housing support comprising:

(1) an upper, rotatable bracket having a lower horizontal member with upwardly extending side members that have upper ends which are pivotally attached, a first attachment means, to the respective lips extending from the lower section of said housing, with said lower horizontal member having a centered, downward extending swivel pin further having a radial groove, (2) a lower stationary bracket comprising:

(a) an upper horizontal member having a centered pin bore therethrough that is sized to rotatably receive the swivel pin, and having a lower side that has attached by a second attachment means, a swivel pin retaining block having a vertical pin bore therethrough that is in alignment with the centered pin bore, with said block further having a threaded, horizontal pin-securing bore that is aligned with the radial groove on the swivel pin, (b) a U-shaped member having a lower horizontal section having upwardly extending side members that are integrally attached to respective ends of the upper horizontal member, (c) a pair of downwardly extending legs rigidly attached, by a third attachment means, to each side member of said U-shaped bracket, (d) a downwardly extending clevis structure rigidly attached, by a fourth attachment means, to the lower horizontal section, and (e) a clamp support link having a first end and a second end, where the first end is swivelly attached, by a fifth attachment means, to the clevis section, d) a threaded bolt and wing nut combination, where when the bolt is threaded into the horizontal pin securing bore and tightened by the wing nut, said lamp housing is secured in a selectable horizontal position, e) a spring-loaded clamp having a first handle and a second handle, where the first handle has an outer surface that is rigidly attached, by a sixth attachment means, to the second end of said support link, where said support link allows said clamp to:

(1) be selectively positioned within an arcuate vertical plane and clamped to a lamp attachment structure, and (2) function as a third leg that when used in combination with the pair of downwardly extending legs, allows said lamp assembly to be stablely placed upon a substantially level surface.

* * * * *